US007800511B1

(12) United States Patent
Hutchison et al.

(10) Patent No.: US 7,800,511 B1
(45) Date of Patent: Sep. 21, 2010

(54) EMERGENCY LIGHTING SYSTEM

(75) Inventors: James R. Hutchison, Belmont, MI (US); Masato Yamazaki, Grand Rapids, MI (US)

(73) Assignee: Living Space International, Inc., Grand Rapids, MI (US)

( * ) Notice: Subject to any disclaimer, the term of this patent is extended or adjusted under 35 U.S.C. 154(b) by 263 days.

(21) Appl. No.: 11/714,943

(22) Filed: Mar. 7, 2007

Related U.S. Application Data

(60) Provisional application No. 60/779,736, filed on Mar. 7, 2006.

(51) Int. Cl.
*G08B 3/00* (2006.01)

(52) U.S. Cl. ..... 340/691.1; 340/3.1; 340/540; 340/332

(58) Field of Classification Search ..... 340/691.1, 340/532, 540, 3.1, 286.05, 332
See application file for complete search history.

(56) References Cited

U.S. PATENT DOCUMENTS

| | | | | |
|---|---|---|---|---|
| 3,969,720 | A | 7/1976 | Nishino | |
| 4,029,994 | A | 6/1977 | Iwans | |
| 4,074,225 | A | 2/1978 | Vandeweghe | |
| 4,173,035 | A | 10/1979 | Hoyt | |
| 4,385,586 | A | 5/1983 | Schriever | |
| 4,401,050 | A | 8/1983 | Britt et al. | |
| 4,422,069 | A | 12/1983 | Edstrom et al. | |
| 4,489,308 | A | 12/1984 | Logan, Jr. et al. | |
| 4,524,304 | A | 6/1985 | Todd | |
| 4,531,114 | A | 7/1985 | Topol et al. | |
| 4,649,376 | A | 3/1987 | Frank | |
| 4,715,743 | A | 12/1987 | Schmanski | |
| 4,754,266 | A | 6/1988 | Shand et al. | |
| 4,794,373 | A * | 12/1988 | Harrison | 340/286.01 |
| 4,801,928 | A * | 1/1989 | Minter | 340/691.2 |
| 5,177,461 | A | 1/1993 | Budzyna et al. | |
| 5,331,918 | A | 7/1994 | Honigsbaum | |
| 5,775,016 | A | 7/1998 | Chien | |
| 5,815,068 | A * | 9/1998 | Vadseth | 340/332 |
| 5,961,072 | A * | 10/1999 | Bodle | 244/118.5 |
| 6,025,773 | A * | 2/2000 | Bresnan | 340/407.1 |
| 6,142,648 | A | 11/2000 | Logan et al. | |
| 6,142,649 | A * | 11/2000 | Beghelli | 362/259 |
| 6,150,943 | A | 11/2000 | Lehman et al. | |
| 6,249,221 | B1 | 6/2001 | Reed | |
| 6,276,634 | B1 * | 8/2001 | Bodle | 244/118.5 |
| 6,313,549 | B1 * | 11/2001 | Moisan et al. | 307/66 |
| 6,317,042 | B1 * | 11/2001 | Engelhorn et al. | 340/539.16 |

(Continued)

*Primary Examiner*—Eric M Blount
(74) *Attorney, Agent, or Firm*—Van Dyke, Gardner, Linn & Burkhart, LLP

(57) ABSTRACT

An emergency lighting system comprises a control system, guide light devices, having multiple light members, guide light controllers, and signal devices. Each guide light controller is adapted to activate at least one guide light device operatively connected to the guide light controller to emit sequentially flashing light signals. Each signal device is adapted to selectively detect an emergency situation and transmit an emergency signal to the control system in response thereto, with each guide light controller being associated by the control system with one of the signal devices. The control system is adapted to transmit control signals in response to the emergency signals to selected ones of the guide light controllers, whereby the guide light controllers receiving emergency signals activate the guide light devices to emit sequentially flashing light signals in one of either two directions with the direction of flashing being controlled by the control signals.

19 Claims, 11 Drawing Sheets

U.S. PATENT DOCUMENTS 6,472,994 B1 * 10/2002 Tator ..... 340/815.4
6,526,200 B1 * 2/2003 Davie ..... 385/31
6,646,545 B2 11/2003 Bligh
6,754,602 B1 6/2004 Tkachenko et al.
6,778,071 B2 * 8/2004 Megerle ..... 340/332
6,998,960 B2 * 2/2006 Buschmann et al. ... 340/286.05
7,199,724 B2 * 4/2007 Danvir et al. ..... 340/691.1
7,218,238 B2 * 5/2007 Right et al. ..... 340/628
7,255,454 B2 * 8/2007 Peterson ..... 362/147
7,423,548 B2 * 9/2008 Kontovich ..... 340/691.1
2002/0057204 A1 * 5/2002 Bligh ..... 340/691.1
2002/0149491 A1 * 10/2002 Crandall et al. ..... 340/691.1
2007/0222626 A1 * 9/2007 Picard et al. ..... 340/584

* cited by examiner

C
B
A
120
183
150
124
170
181
180
118
135
186

EMERGENCY LIGHTING SYSTEM

CROSS REFERENCE TO RELATED APPLICATION

The present application claims priority of U.S. provisional application Ser. No. 60/779,736, filed Mar. 7, 2006, by James R. Hutchison for EMERGENCY LIGHTING SYSTEM, which is hereby incorporated herein by reference in its entirety.

BACKGROUND OF THE INVENTION

The present invention is directed to an emergency lighting system, and in particular to an emergency lighting system adapted to selectively provide light signals to guide occupants from an interior location.

Emergency lights within interior locations are known that are caused to activate in the event of an emergency. Various forms of such emergency lights are mounted to ceilings or to walls in close proximity to ceilings. However, such emergency lights may suffer from the disadvantage of being blocked by rising smoke during a fire. In addition, some emergency lights merely provide illumination of an exit location or general illumination of an area, which may not help occupants within the building or structure that are not in view of the exit location, or are unfamiliar with the location of the exits. Other known forms of emergency lights utilize floor mounted lights that are installed during construction of the structure. While such emergency lights are able to provide light that is less likely to be obscured by smoke, these systems are typically costly, difficult to install, and cannot be readily utilized or retrofitted into existing buildings.

Therefore, there is a need in the art for an emergency lighting system in which the illumination provided is less susceptible to being blocked by rising smoke, is readily adaptable to being installed within a variety of interior locations, and which benefits occupants more than merely illuminating certain locations.

SUMMARY OF THE INVENTION

The present invention provides an emergency lighting system that is able to guide and/or direct egress by occupants of an interior location of a structure, such as a building, ship or the like, based upon information relating to the location or locations of emergency situations within the interior location, such as a fire, whereby the occupants are guided away from obstructed or more hazardous locations and toward an appropriate egress.

According to an aspect of the present invention, an emergency lighting system for guiding occupants from an interior location of a structure comprises a control system and at least one guide light device adapted for installation within the interior location and including multiple illumination sources that are selectively activable to emit light signals. The control system is operable in response to at least one emergency input signal to selectively activate the illumination sources of the at least one guide light device. The guide light device is mountable to a generally vertical surface within the interior location proximate a floor and is selectively controlled by the control system in response to the at least one emergency input signal to provide the light signals to guide occupants in either one of at least two directions from the interior location.

According to another aspect of the present invention, a method of guiding occupants from an interior location of a structure in which an emergency situation has arisen comprises providing at least one guide light device having multiple lights therealong, attaching the at least one guide light device to a generally vertical surface within the interior location proximate a floor, detecting the existence of an emergency situation within the interior location, and generating at least one emergency signal in response to the detection of an emergency situation. The method further comprises selectively activating the at least one guide light device to emit light signals in response to the at least one emergency signal, and guiding occupants in either one of at least two directions away from the emergency situation and from the interior location with the light signals.

According to still another aspect of the present invention, an emergency lighting system adapted to guide occupants from an interior location of a structure comprises a control system, multiple guide light devices, each of which includes multiple light members selectively activable to emit light signals, multiple guide light controllers, and multiple signal devices. Each guide light controller is adapted to activate at least one guide light device that is operatively connected to the guide light controller to emit sequentially flashing light signals. Each signal device is adapted to selectively detect an emergency situation within an interior location and transmit an emergency signal to the control system in response to the emergency situation, with each guide light controller being associated by the control system with one of the signal devices. The control system is adapted to transmit control signals in response to the emergency signals to selected ones of the guide light controllers, whereby the guide light controllers receiving emergency signals activate the guide light devices to emit sequentially flashing light signals in one of either two directions with the direction of flashing being controlled by the control signals.

In other aspects of the emergency lighting system, the control system does not transmit control signals to guide light controllers associated with the signal devices transmitting emergency signals to the control system. In a further aspect, the control system transmits control signals to the guide light controllers associated with the signal devices that are not transmitting emergency signals to the control system, with the guide light controllers receiving the control signals activating the guide light devices in response to the control signals to emit sequentially flashing light signals in a direction away from the signal devices transmitting the emergency signals to the control system. In an aspect of the emergency lighting system the control system is a conventional fire alarm panel.

Therefore the present invention provides an emergency lighting system that is readily installable within all manner of interior locations of structures such as buildings and ships to selectively provide light signals that may guide occupants within the interior location both away from obstructed areas, based on the detected locations of emergency situations or hazardous areas, and out of the interior location. The guide light devices of the emergency lighting system are mountable to a generally vertical surface, and may form a base molding, or portion of a base molding, such that they are readily installable to new or existing structures and do not detract from the aesthetic appearance of the structure. In addition, the guide light devices are able to provide light signals that are less likely to be blocked by smoke and which may selectively direct occupants in either one of at least two directions via arrows and/or sequentially flashing lights that form a "chasing" pattern.

These and other objects, advantages, purposes and features of this invention will become apparent upon review of the following specification in conjunction with the drawings.

DESCRIPTION OF THE PREFERRED EMBODIMENTS

Figure 1:
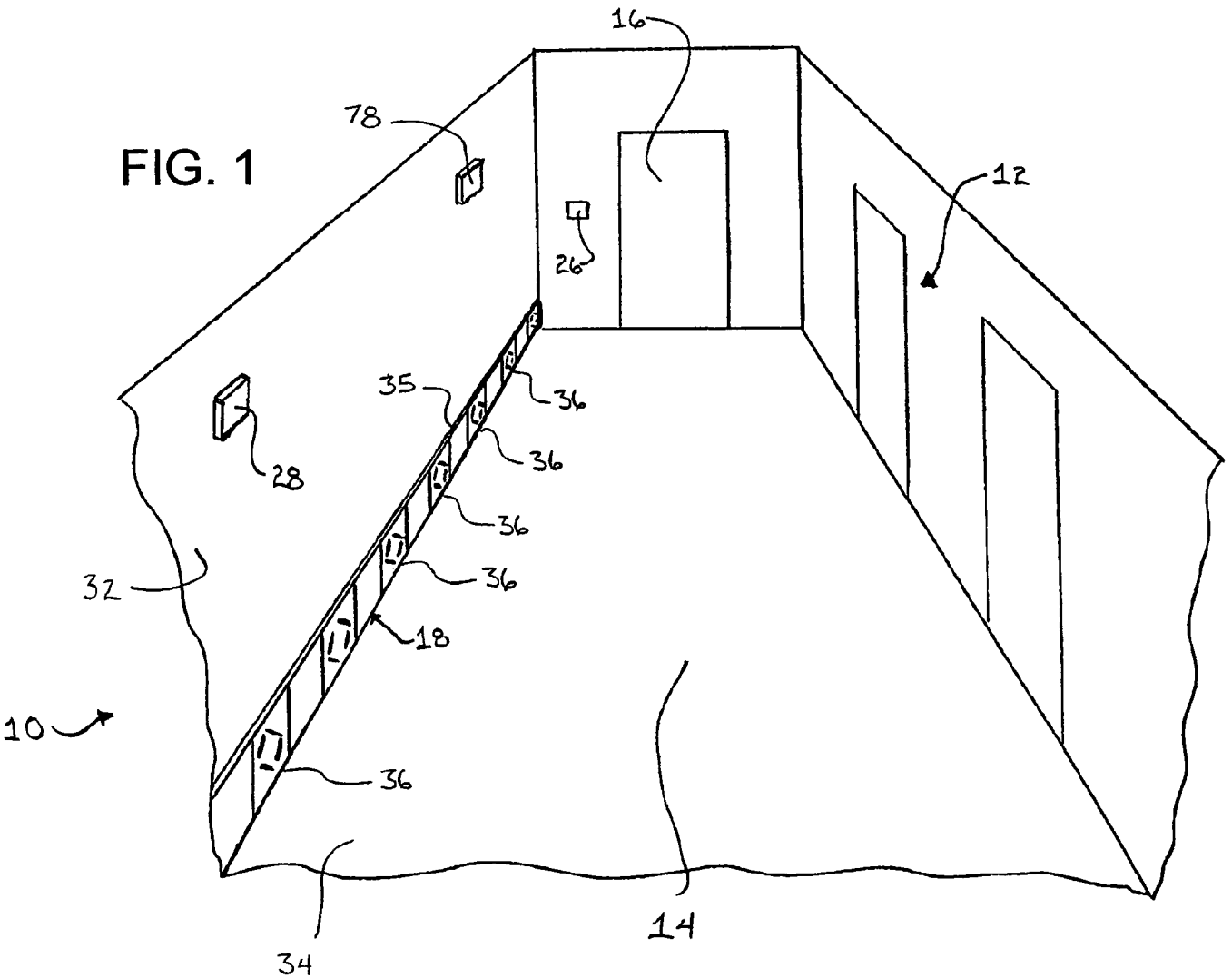
FIG. 1 is a partial perspective view of an emergency lighting system according to the present invention installed within an interior hallway.

The present invention will now be described with reference to the accompanying figures, wherein the numbered elements in the following written description correspond to like-numbered elements in the figures. An emergency lighting system 10 is illustrated in FIG. 1 installed within an interior location 12, such as the hallway 14 shown, within a structure such as a building, shipping vessel, home or apartment building. Emergency lighting system 10 functions to guide and/or direct the egress of occupants from the interior location 12, such as toward an exit 16, in the event of an emergency situation occurring within interior location 12, such as a fire, explosion, or the like. Emergency lighting system 10 guides and directs occupants based upon the location of an emergency situation or hazardous location such that the occupants are able to avoid obstructed or more dangerous areas while egressing interior location 12, as discussed below.

Figure 2:
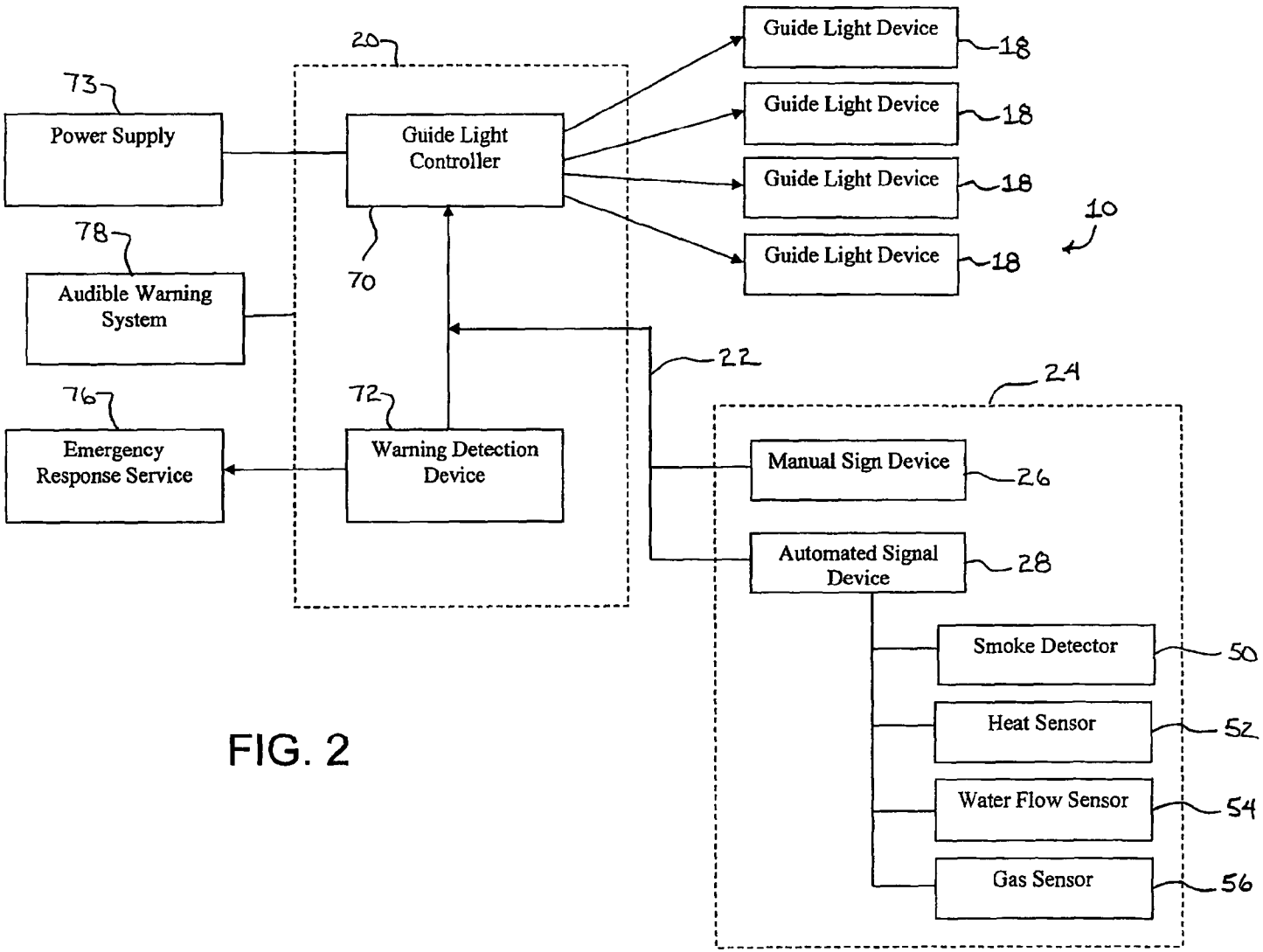
FIG. 2 is a schematic illustration of the emergency lighting system of FIG. 1.

Referring now also to FIGS. 1 and 2, emergency lighting system 10 includes multiple guide light devices 18 (only one shown in FIG. 1) and a control system 20 that receives emergency input signals or emergency signals or input signals 22 from one or more signal devices 24, such as a manual signal device or manual alarm 26 or an automated signal device or automated alarm 28, as described below, that are variously positioned within the interior location 12. Control system 20 is provided with the overall layout of the interior location 12, such as the location of exits 16, hallways 14, and rooms (not shown in FIGS. 1 and 2), as well as with the location or position of signal devices 24 and guide light devices 18 relative to interior location 12. Thus, control system 20 is operable in response to an input signal 22 from one or more signal devices 24 to determine the relative location of an emergency situation within a structure. In further response to the emergency input signal 22, control system 20 selectively activates one or more of the guide light devices 18 to emit light signals 30 (FIG. 4) that provide a visual indicator or prompt to occupants of interior location 12 to indicate which direction the occupant should proceed to exit the interior location 12. The light signals 30 may be emitted, as described below, in a sequentially flashing manner to produce a visual "chasing" effect to indicate, or further indicate, the direction in which occupants should proceed.

As described in more detail below, guide light devices 18 provide directional light signals 30 in either one of two directions, such as either toward exit 16 or away from exit 16 and toward a different exit (not shown). As noted above, control system 20 is operable to determine or detect the general location or position of a hazardous or obstructed area based on the emergency input signal 22 received from a given signal device 24. In response to such a determination, emergency lighting system 10 selectively provides directional light signals 30 that guide occupants both from interior location 12 and away from the emergency situation in a safe and expeditious route. In addition to providing such directional guidance, guide light devices 18 may also, as described below, provide general illumination of the interior location 12 to improve visibility for occupants during such an emergency.

As shown in FIG. 1, guide light device 18 is mounted to vertical wall 32 adjacent floor or floor surface 34 of hallway 14. Because smoke rises, the positioning of guide light device 18 adjacent floor surface 34 provides improved visibility as compared to overhead mounted lighting systems. As can be seen with reference to FIG. 4, guide light device 18 may be constructed to have a relatively thin or narrow profile, and may be generally flexible such that guide light devices 18 may be readily affixed around curves and corners. Guide light devices 18 may also be readily affixed using adhesives, fasteners, clips, or the like (not shown) to generally vertical surfaces, such as wall 32 or to a baseboard or base molding 35, or the like.

Guide light devices 18 are thus readily installable on various floor plans, whether during new construction or as a retrofit to an existing structure, and may be readily re-configured in the event of alterations or renovations to a floor plan. Guide light devices may also be constructed to form, or partially form, or to have the appearance of, a baseboard or base molding 35 of hallway 14 such that, when not providing emergency lighting, they do not detract from the overall aesthetic appearance of the facility in which they are installed. For example, guide light devices may include a tinted, translucent cover (not shown) such that the emergency lighting capability of the guide light devices is less obvious when not in use. Guide light device 18 is also substantially waterproof to impede water damage from overhead sprinkler systems or from firefighters.

Figure 3A:
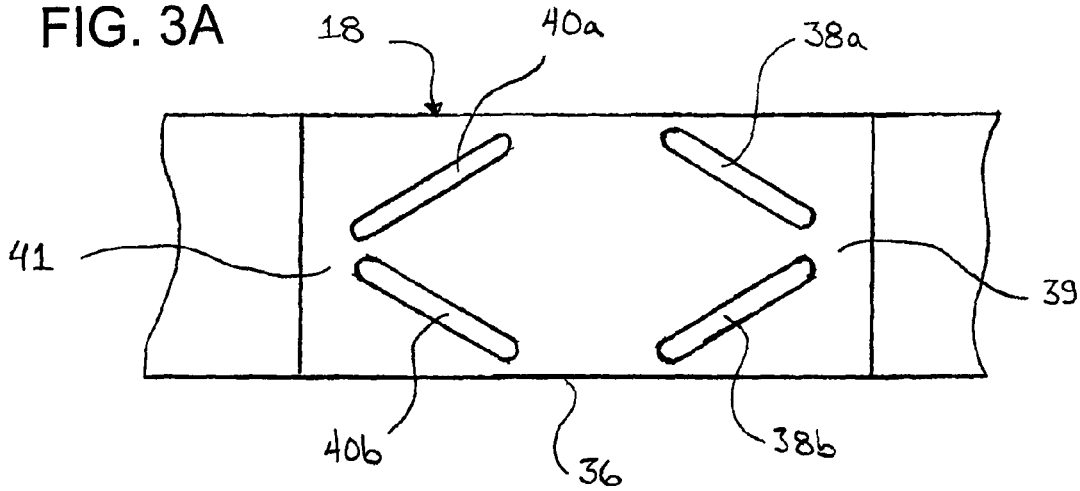
FIG. 3A is a partial front elevation view of the guide light device component of the emergency lighting system of FIG. 1.
Figure 4:
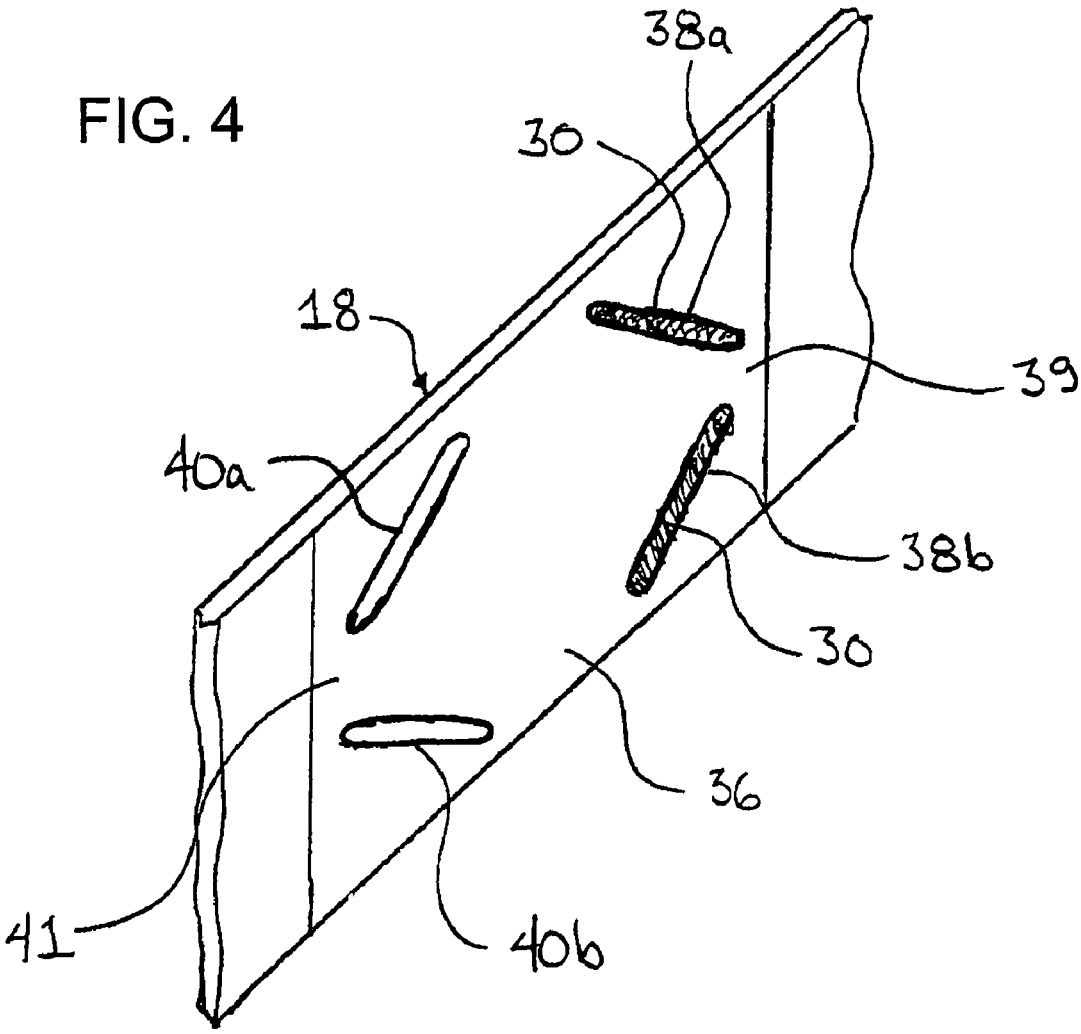
FIG. 4 is a partial perspective view of the guide light device of FIG. 3A illustrating activation of the guide light device to product light signals.

Guide light device 18 includes multiple light units 36 that are spaced from one another and joined together to form an elongated strand extending along hallway 14. Light units 36 of guide light device 18, as shown in FIG. 3A, are constructed to include four directional indicating light members or light sources or illumination sources 38*a*, 38*b*, 40*a*, 40*b*. As viewed in FIG. 3A, light members 38*a* and 38*b* are angled with respect to one another to form a generally right directed arrow 39, and light members 40*a* and 40*b* are angled with respect to one another to form a generally left directed arrow 41. Selective illumination of either light members 38*a* and 38*b*, or light members 40*a* and 40*b*, thus provides a directional light signal to guide an occupant of interior location 12 as to which direction along hallway 14 the occupant should proceed to safely and/or quickly exit the building. For example, illumination of light members 38*a* and 38*b* as illustrated in FIG. 4 would direct an occupant to proceed in one direction, while illumination of light members 40*a* and 40*b* would direct an occupant to proceed in the opposite direction, depending on the relative location of a hazardous condition and/or an exit as discussed below.

Desirably, light members 38, 40 are constructed as low-voltage LED lights to minimize power consumption while providing sufficient illumination to guide occupants. However, other types of light members, such as incandescent or halogen lights, may alternatively be used and still function as intended within the scope of the present invention. Although left arrow 41 and right arrow 39 are each constructed of two light members 38, 40, it should also be appreciated that left and right arrows may be alternatively formed from single light members or more than two light sources. Further, although light units 36 are illustrated in FIG. 1 as being spaced from adjacent light units 36, a guide light device may alternatively be constructed with light units that are directly adjacent neighboring light units.

Figure 3B:
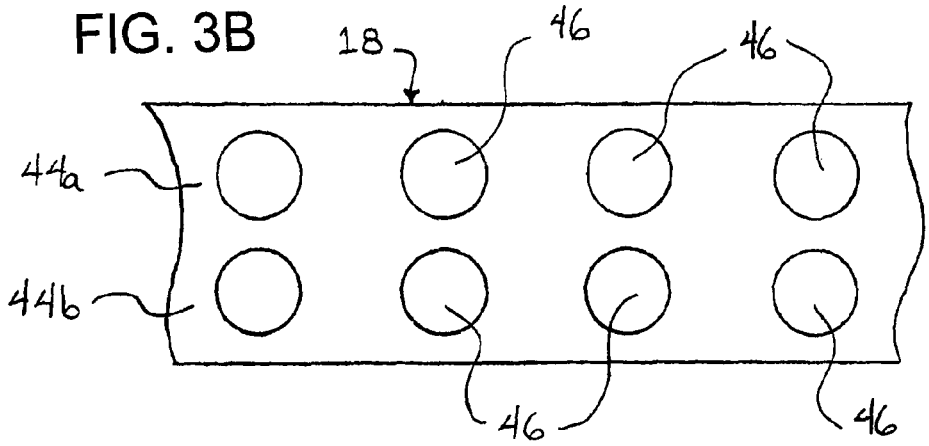
FIG. 3B is a partial front elevation view of an alternative guide light device.

Referring now to FIG. 3B, an alternative guide light device 18' is illustrated that is constructed to include two rows 44*a*, 44*b* of light members 46 extending along the length of guide light device 18'. Light members 46, in a similar manner to light members 38, 40 discussed above, are constructed as LED lights. Light members 46 of guide light device 18', however, are not separated into individual, separate light units 36 as with guide light device 18 discussed above. Optionally, light members 46 of row 44*a* may emit light signals of a different color from light signals emitted by light members 46 of row 44*b*. For example, light members 46 of row 44*a* may emit red light signals and light members 46 of row 44*b* may emit green light signals. The ability to emit different colored light signals may be used to indicate different types of emergency situations, to distinguish between a training drill and an actual emergency, or to indicate that an emergency situation no longer exists, or the like. Alternatively, a guide light device may be employed that is of generally similar construction to guide light device 18', but which has a single row of light members, or the light members may be constructed such that each light member is able to emit more than one color such as, for example, red, green, and blue.

It should be appreciated that in addition to guide light devices 18, 18' discussed above, alternative guide light devices may be constructed and still function as intended within the scope of the present invention. For example, a guide light device may be constructed as a combination of both guide light devices 18, 18' discussed above, with light units, such as light units similar to light units 36 of guide light device 18, separated by segments constructed to include other light members, such as light members similar to light members 46 of guide light device 18'. Such an alternative guide light device, when in use, may function to constantly illuminate either left or right direction arrows while sequentially flashing light members located between the arrows in the manner discussed below. Another alternative guide light device in accordance with the present invention may be formed by affixing various light members and/or light units to an existing baseboard or base molding, with the light members and/or light units being in electrical communication with the control system of the emergency lighting system. In such an embodiment, the electrical strands or cables (not shown) extending to the control system may be, for example, tucked or secured behind the base molding or tucked into the joint of the base molding with the floor. Still further, both rows 44*a*, 44*b* of light members 46 of guide light device 18' may be constructed to emit the same color light and/or may be illuminated at the same time during an emergency. The various guide light devices discussed above may be constructed, for example, using components from the ColorFlex product line of lighting components supplied by Color Kinetics, Inc. of Boston, Mass.

Figure 5:
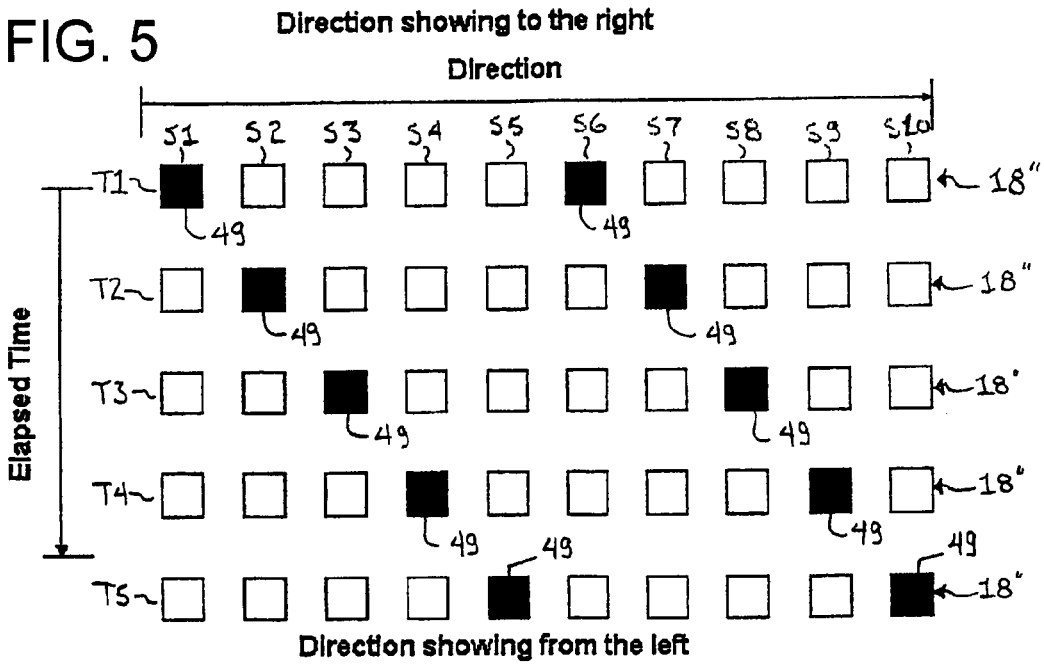
FIG. 5 is a schematic illustration of a guide light device providing, as viewed, a rightward directional signal.
Figure 6:
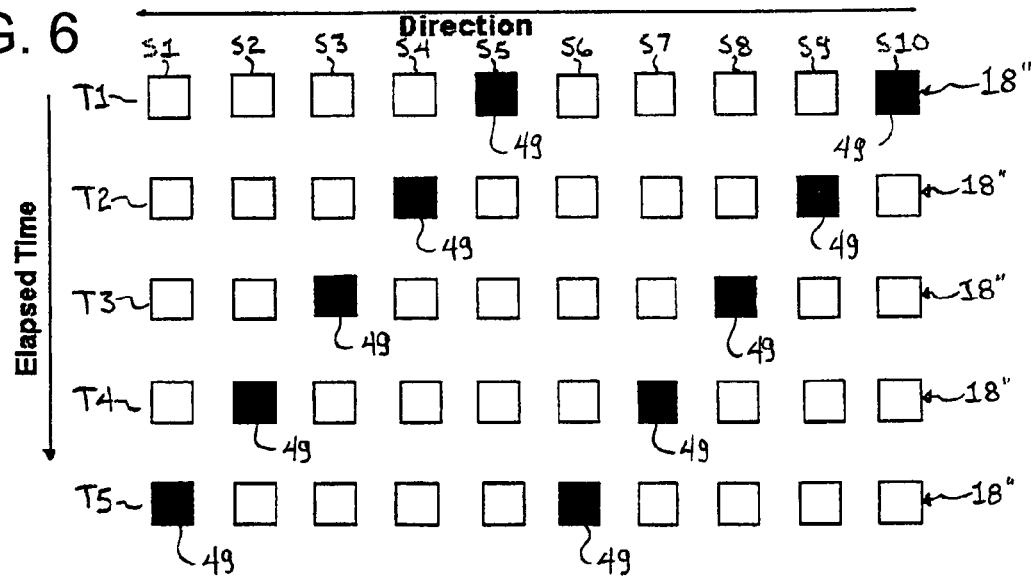
FIG. 6 is a schematic illustration of the guide light device of FIG. 5 providing, as viewed, a leftward directional signal.

Guide light devices 18, 18' may be operated to emit sequentially flashing light signals to produce a visual "chasing" effect that directs occupants in either direction along a hallway. Referring to FIGS. 5 and 6, and as viewed therein, a single guide light device 18" (shown at five different elapsed times, T1 to T5), may selectively provide rightward guidance (as shown in FIG. 5) or leftward guidance (as shown in FIG. 6). Guide light device 18" is illustrated to include ten indicating spaces, S1 to S10, each of which may be constructed as either a light unit 36 or a light member 46, as described above, or the like. As viewed in FIG. 5, guide light device 18" may provide sequential light signals 49 to direct an occupant rightward, with indicating spaces S1 and S6 illuminated at T1; indicating spaces S2 and S7 illuminated at T2; indicating spaces S3 and S8 illuminated at T3; indicating spaces S4 and S9 illuminated at T4; and indicating spaces S5 and S10 illuminated at T5. Conversely, as viewed in FIG. 6, guide light device 18" may provide sequential light signals 49 to direct an occupant leftward. It should be understood that when directional light units (such as light units 36 of guide light device 18 described above) are employed, light members 38*a*, 38*b* are illuminated to provide guidance to an occupant in one direction and light members 40*a*, 40*b* are illuminated to provide guidance in the opposite direction.

Indicating spaces S1 to S10 are shown in FIGS. 5 and 6 with four non-illuminated light units or light members between the illuminated units or light signals 49. It should be understood, however, that more or fewer non-illuminated light units or light members may be positioned between illuminated light signals 49 depending upon the length of guide light device 18" and the spacing between adjacent light units or light members. Further, although illustrated as selectively illuminating various light units or light members while not illuminating other such light units or light members, the guide light device may be alternatively constructed and controlled and still function as intended within the scope of the present invention. For example, during an emergency, all light units or light members of a guide light device may be illuminated to a first dimmer level with selective sequential brightening or illumination of individual light units or light members to provide the above discussed visual guidance effect.

As noted above, guide light device 18 is controlled by control system 20 in response to one or more emergency input signals 22 from one or more signal devices 24 located at various locations within the interior of a building. Signal devices 24 may be constructed to be either manual alarms or manual signal devices 26, or automated alarms or automated signal devices 28 (see FIG. 2). For example, manual signal devices 26 may be activated by an occupant of interior location 12 in a conventional manner, such as by pulling a handle or depressing a button. Automated signal devices 28 may be constructed as smoke detectors 50, heat sensors 52, water flow sensors or meters 54, or gas sensors 56 such as carbon monoxide or carbon dioxide detectors. In the case of water flow meters 54, water pipes for an overhead sprinkler system may include such sensors to detect when a sprinkler has been activated, with such information then being conveyed to the control system 20.

Figure 7:
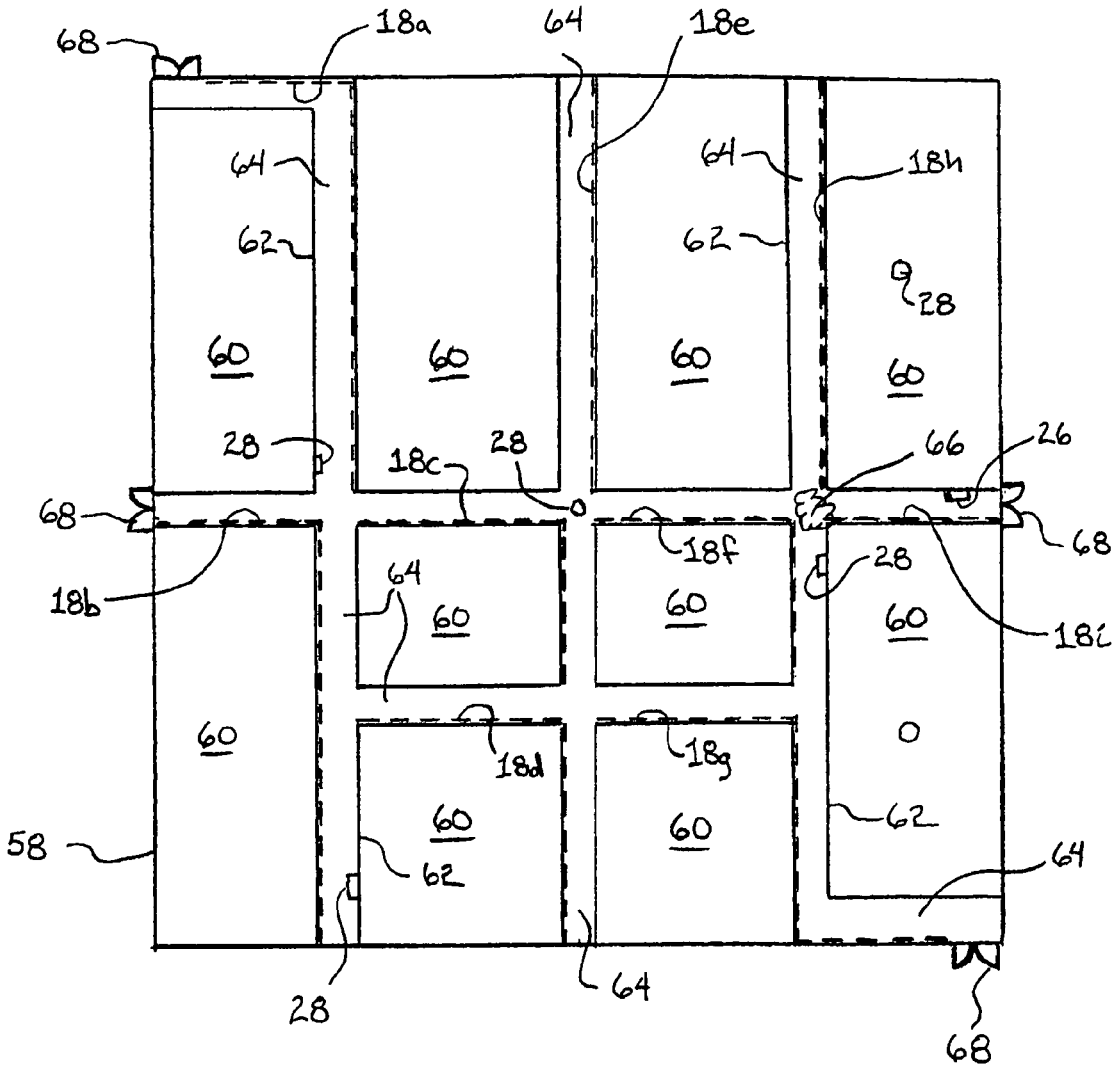
FIG. 7 is a top plan view of a floor plan employing an emergency lighting system according to the present invention.

FIG. 7 illustrates a layout or floor plan 58 of a building, such as an office building, house, hotel, hospital, or apartment building. Various manual signal devices 26 and automated signal devices 28 are positioned throughout the building, such as within rooms 60, or against walls 62, or on ceilings (not shown) within hallways 64. The position or relative location of each signal device 24 relative to the layout or floor plan of the building is preprogrammed into control system 20. Likewise, the location of the light devices 18 relative to the floor plan and of the hallways 64 and exits 68 of the floor plan 58 is also programmed into the control system 20. Thus, the control system 20 is programmed with the relative locations or coordinates of the signal devices 24 and the light devices 18 within the building and spaced throughout the floor plan or layout of the building.

An emergency situation 66, such as smoke and/or fire, will trigger automated signal devices 28 located proximate the emergency situation 66. Alternatively, or in addition thereto, any occupants of the building (or level or floor of the building at which the system is located) observing emergency situation 66 may activate manual signal devices 26. In turn, the triggered or activated signal devices 26, 28 will transmit emergency input signals 22 to control system 20. Because the location of each signal device 26, 28 relative to the building layout is programmed into control system 20, control system 20 is thus provided with the general location of the emergency situation 66 relative to the floor plan or layout based on the activated or triggered signal devices 26, 28 located proximate the emergency situation 66.

Control system 20, in addition to being preprogrammed with the location of each signal device 26, 28 relative to the building layout, is also preprogrammed as to the location of exits 68 from the building and the location of guide light devices 18*a* to 18*i* (illustrated by dashed lines) relative to the various hallways and exits. Thus, in response to an emergency situation 66, control system 20 is able to selectively activate one or more of the various guide light devices 18*a* to 18*i* to provide light signals in the manner described above that direct occupants away from the emergency situation 66 and toward an unobstructed exit 68. Although FIGS. 1 and 7 illustrate a single guide light device 18 along each hallway 14, 64, it should be appreciated that guide light devices may alternatively be included on both walls of hallways in a particular facility. It should also be appreciated that guide light devices may be used adjacent steps within a facility, such as within an emergency exit stairwell. Further, an emergency lighting system may control multiple floors or levels of a building or structure, with the control system being able to simultaneously guide occupants from the building based on one or more emergency situations occurring on different floors. For example, occupants may be guided partially down one flight of stairs, across a floor, and directed to another flight of stairs to exit the building. Still further, additional guide lights may be located on ceilings or other wall locations.

Control system 20 may receive input signals 22 via electrical wires or cables (not shown) and control guide light devices 18 via similar such electrical wires or cables, with the various signal devices 24 and guide light devices 18 being hardwired to control system 20. Alternatively, the control system may receive wireless input signals and transmit wireless control signals. The control system may also receive GPS signals from the signal devices and guide light devices to establish their relative location as opposed to being preprogrammed with such position information.

Commercial buildings typically include, as required by fire safety codes, various types of warning detection devices that monitor and detect signals from signal devices and in response transmit an alert signal to an emergency response service, such as a fire and/or police department. Control system 20, as illustrated in FIG. 2, thus may include both a guide light controller 70 and a warning detection device or alarm detection system 72, with control system 20 constructed to receive emergency input signals 22 that are directed to both the guide light controller 70 and the warning detection device 72. In response, warning detection device 72 may transmit an alert signal 74 to an emergency response service 76. Guide light controller 70, in response to emergency input signals 22, controls which guide light devices 18 are activated and the manner in which the light signals 30 are displayed to selectively direct egress of the occupants. Alternatively, an emergency input signal may be transmitted to either guide light controller 70 or to warning detection system 72 with guide light controller 70 or warning detection system 72 subsequently relaying the emergency input signal to the other of the guide light controller 70 or warning detection system 72. The use of a separate guide light controller 70 may provide the ability to integrate the emergency lighting system 10 of the present invention into existing buildings. However, although control system 20 is illustrated in FIG. 2 to include a separate guide light controller 70 and a separate warning detection device 72 (which may be an existing warning detection device), it should be appreciated that a control system may be alternatively constructed to integrate the guide light controller and warning detection device into a single control apparatus.

In the illustrated embodiment, each guide light device 18, 18' comprises a string or series of light units 30 or light members 46. Two or more strings of guide light devices 18, 18' may be required to be connected together, such as in electrical series connection, depending upon a particular application such as, for example, along a long hallway. Each guide light device 18, 18' or light unit 30 or light member 46 may be individually controlled via guide light controller 70. As shown in FIG. 2, a separate power supply 73 may be used to provide power to guide light controller 70 and to power guide light devices 18, where power supply 73 may be constructed as a battery pack, a generator, or a separate power line from the power line or power lines supplied to the facility within which emergency lighting system 10 is installed. Although power supply 73 is illustrated in FIG. 2 as supplying power to guide light controller 70, with guide light controller 70 in turn controlling guide light devices 18, it should also be appreciated that an alternative power supply could be utilized that both supplies power to a guide light controller and receives control signals from the guide light controller, with the power supply in turn controlling the guide light devices.

As previously noted, in addition to the directional guidance lighting provided by the guide light devices 18, 18', the guide light devices may also provide general illumination of an interior location to improve visibility for occupants during egress. For example, the guide light device may illuminate the floor area of the hallway at which it is positioned. Such general illumination may be provided, for example, by one or more lighting members remaining constantly illuminated while other such lighting members provide the sequential, chasing directional light guidance. Optionally, the guide light devices may also include additional and/or alternative lighting units or lighting members to provide general illumination of the interior location at which they are located.

Emergency lighting system 10 may further include or be integrated with an audible warning system 78 (FIGS. 1 and 2). Audible warning system 78 may provide, for example, a warning buzzer or siren. Audible warning system 78 may also or alternatively provide verbal instructions to occupants of the interior location directing them, for example, to follow the directional light signals 30 to unobstructed exits 16.

Referring now to FIGS. 8-11, an alternative emergency lighting system 110 is shown that is of generally similar construction to the above discussed emergency lighting system 10, with the common or similar components or elements of emergency lighting system 110 being shown with similar reference numbers as used in FIGS. 1-7 with respect to emergency lighting system 10, but with 100 added to the reference numbers of FIGS. 8-11. It should be understood that, because of the similarity of emergency lighting system 110 to emergency lighting system 10, not all of the specific construction and alternatives of like referenced parts will be discussed in the following discussion of emergency lighting system 110.

Figure 8:
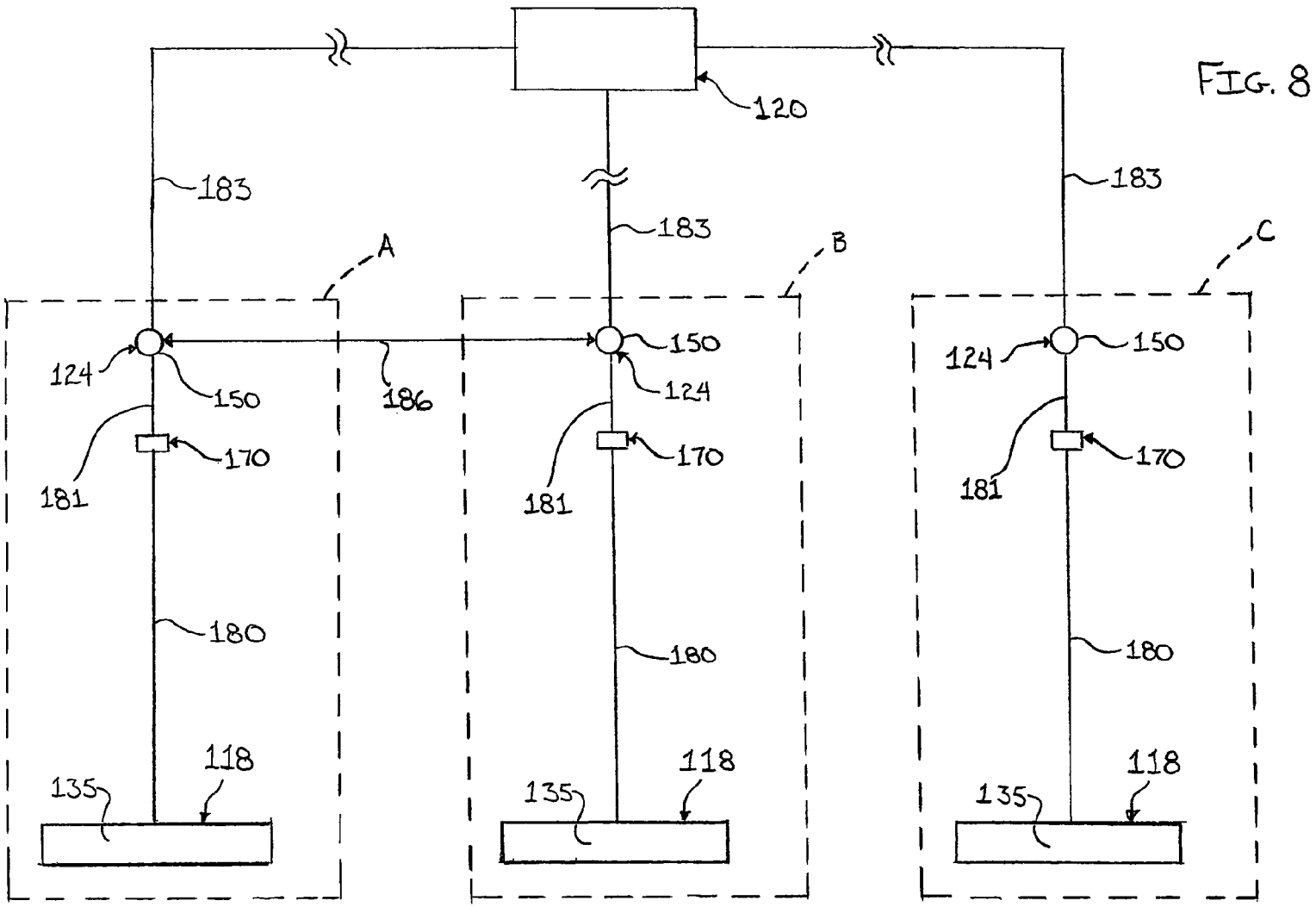
FIG. 8 is a schematic illustration of another emergency lighting system according to the present invention.

As illustrated in FIG. 8, emergency lighting system 110 includes multiple branches A, B, C, each of which consists of a guide light device 118 operatively connected to a guide light controller 170, which in turn is connected to a signal device 124. In the illustrated embodiment, signal device 124 is a smoke detector 150, such as a SimplexGrinnell detector supplied by Tyco Fire & Security of Florida or an EST detector supplied by Edwards Systems Technology of Connecticut, a division of the General Electric Corporation. Each smoke detector is, in turn, connected to a control system 120 of the emergency lighting system 110. Although only three branches A, B, C, each being a combination of a guide light device 118, a guide light controller 170, and a smoke detector 150 are shown connected to control system 120, it should be understood, as described in more detail below, that an emergency lighting system 110 may include numerous additional such branches or combinations.

Emergency lighting system 110 is adapted for use in an interior location, such as within a building. The distance 186 between smoke detectors 150 within such a building may be mandated by fire safety codes, and in which case, for example, could be set at approximately 35 feet. The operation of emergency lighting system 110 is described in more detail below. In general, however, guide light controllers 170 operate to control the sequential flashing of light members 146 (FIG. 9) via signals transmitted along cable or line 180, with light guide controllers 170 triggered to operate the guide light devices 118 upon either the sensing of smoke by a smoke detector 150 and/or upon the triggering of a smoke alarm 150 by control system 120. Guide light controllers 170 may be selectively adjusted to control both the direction of the sequential flashing of light members 146 and the pace or rate or frequency of the flashing, with the adjustments taking place manually. The guide light controllers 170 and guide light devices 118 are installed at known locations relative to the exits from the building within which they are installed. As such, the guide light devices 118 may be programmed or manually adjusted during installation to direct egress from the building based on the location of a particular smoke detector 150 relative to an exit, stairwell, hallway, or the like.

Figure 9:
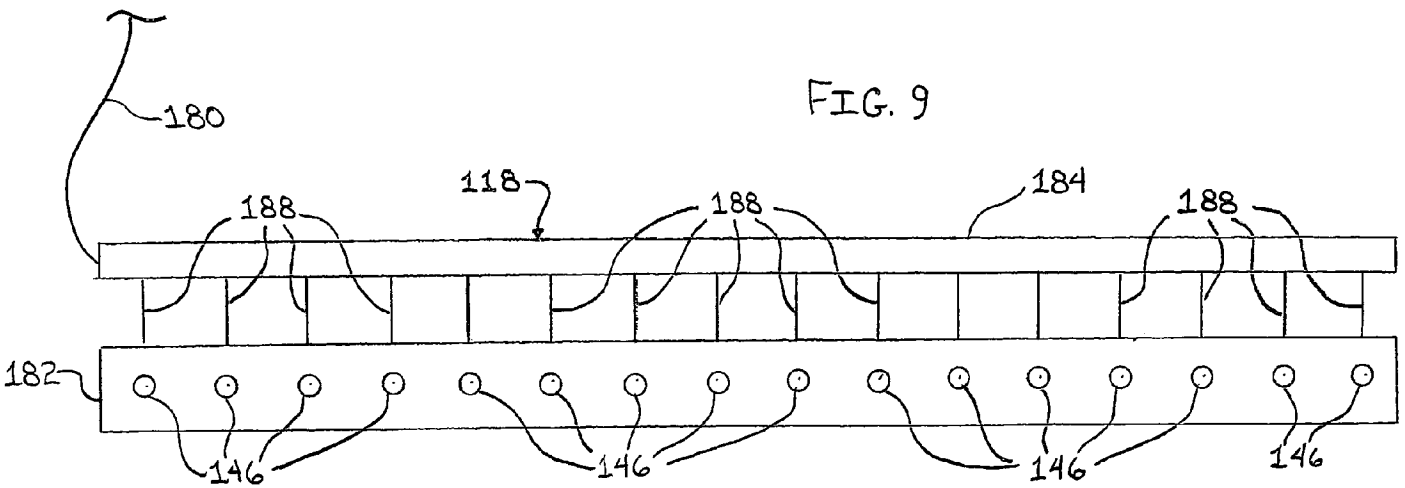
FIG. 9 is a schematic illustration of a guide light device of the emergency lighting system of FIG. 8.

Referring to FIG. 9, a guide light device 118 is shown to include both a light strand 182 and a power strip 184. Light strand 182 has a length of approximately 18 to 20 feet and includes sixteen light members 146. In the illustrated embodiment, light members 146 are LED lights, such as Telux™ TLWR8900 LED lights supplied by Vishay Semiconductor GmbH of Germany. Each light member 146 may be installed within or embedded in a member, such as a vinyl or carpet like material, or the like, whereby light strand 182 forms a baseboard or base molding 135. Such a base molding 135 may be flexible to extend around corners or curves, or may be fabricated using a more rigid material or thicker material such that it is not flexible, such as thicker plastic materials, wood, or steel.

Power strip 184 is a ribbon cable connector, such as a Scotchflex Flat Ribbon Cable, model number 925918-20-126-R supplied by the 3M Corporation. Each light member 146 is connected to power strip 184 by connectors 188, with power strip 184 in turn being connected to cable 180, which may also be a ribbon cable connector. As described in more detail below, signals are transmitted from guide light controller 170 via cable 180 to power strip 184 such that the light members 146 may be selectively supplied with power to flash in the desired sequential manner and at the desired pace. Power strip 184 may be placed between the guide light device 118 and wall to which guide light device 118 is affixed. Cable 180 may be located behind the wall and extend up to smoke detector 150, which may be mounted to the wall or in the ceiling of the building or other structure within which emergency lighting system 110 is installed. It should also be appreciated that cable 180 and power strip 184 may comprise a single cable or connector, such as a previously noted 3M Scotchflex ribbon cable.

Figure 10:
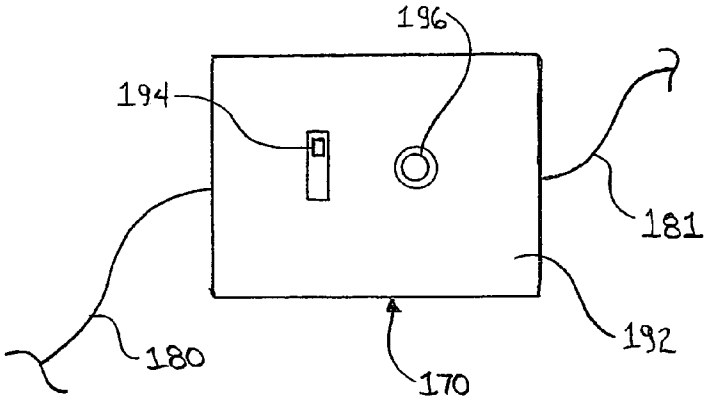
FIG. 10 is a schematic illustration of a guide light controller of the emergency lighting system of FIG. 8.

Referring now to FIG. 10, the illustrated guide light controller 170 includes a circuit 190 (FIG. 12) contained within a housing 192, with circuit 190 adapted to direct the timing and sequential direction of the illumination of light members 146. Guide light controller 170 includes selective inputs for adjusting circuit 190 regarding both the direction of sequential flashing of the light members 146, as well as the pace or rate at which light members 146 flash. The inputs include both a directional input switch 194 and a rate adjustment dial 196. Directional input switch 194 may be selectively placed in one of two positions. When switch 194 is placed in one of the positions, the light members 146 are caused to flash in a manner indicating one direction, such as a left-to-right direction, and when placed in the other of the positions, the light members 146 are caused to flash in a manner indicating the opposite direction. Rate adjustment dial 196 may be rotated to increase or decrease the rate at which the light members 146 flash.

Figure 11:
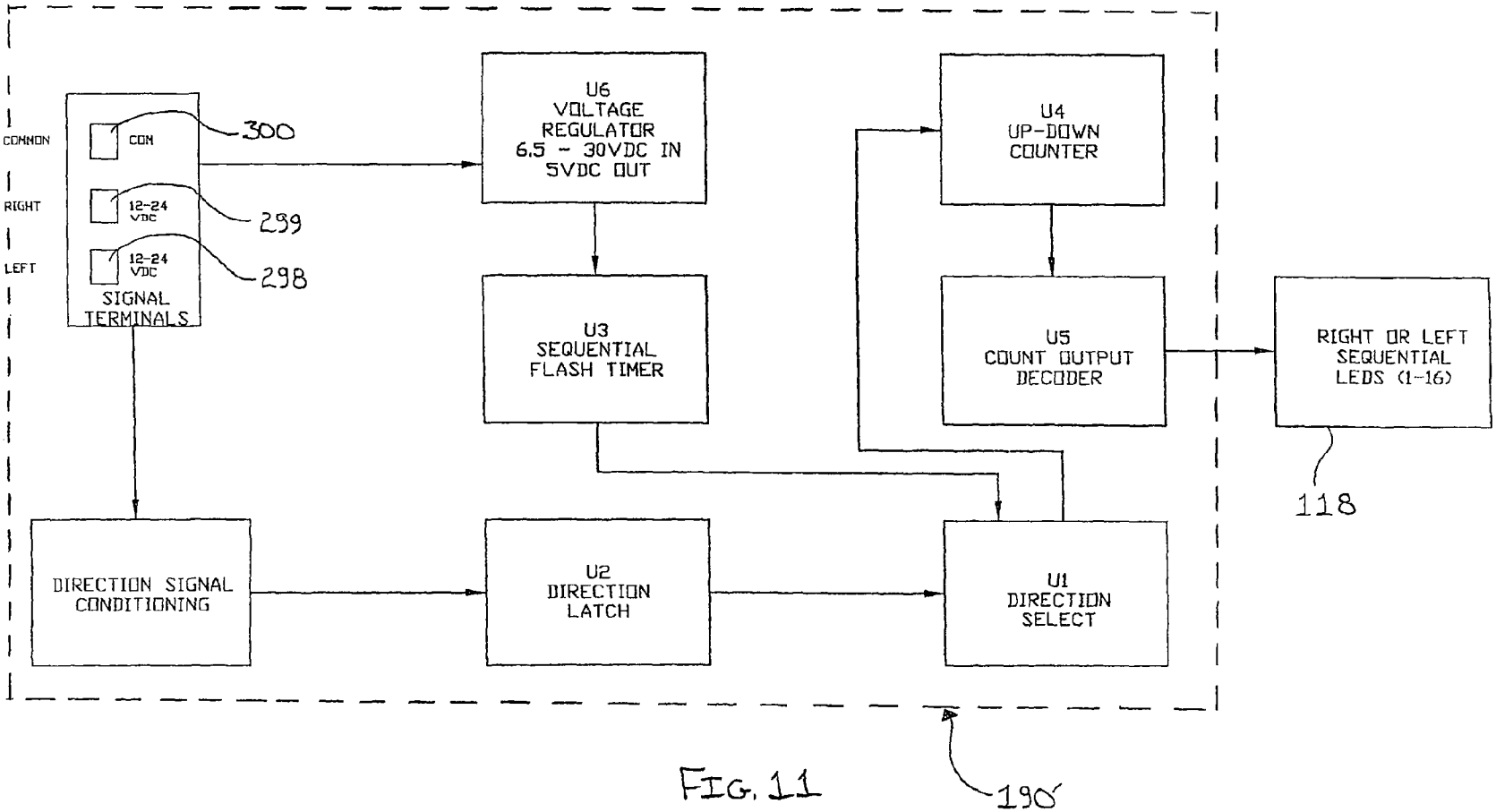
FIG. 11 is a schematic illustration of the circuit of the guide light controller of FIG. 10.
Figure 12:
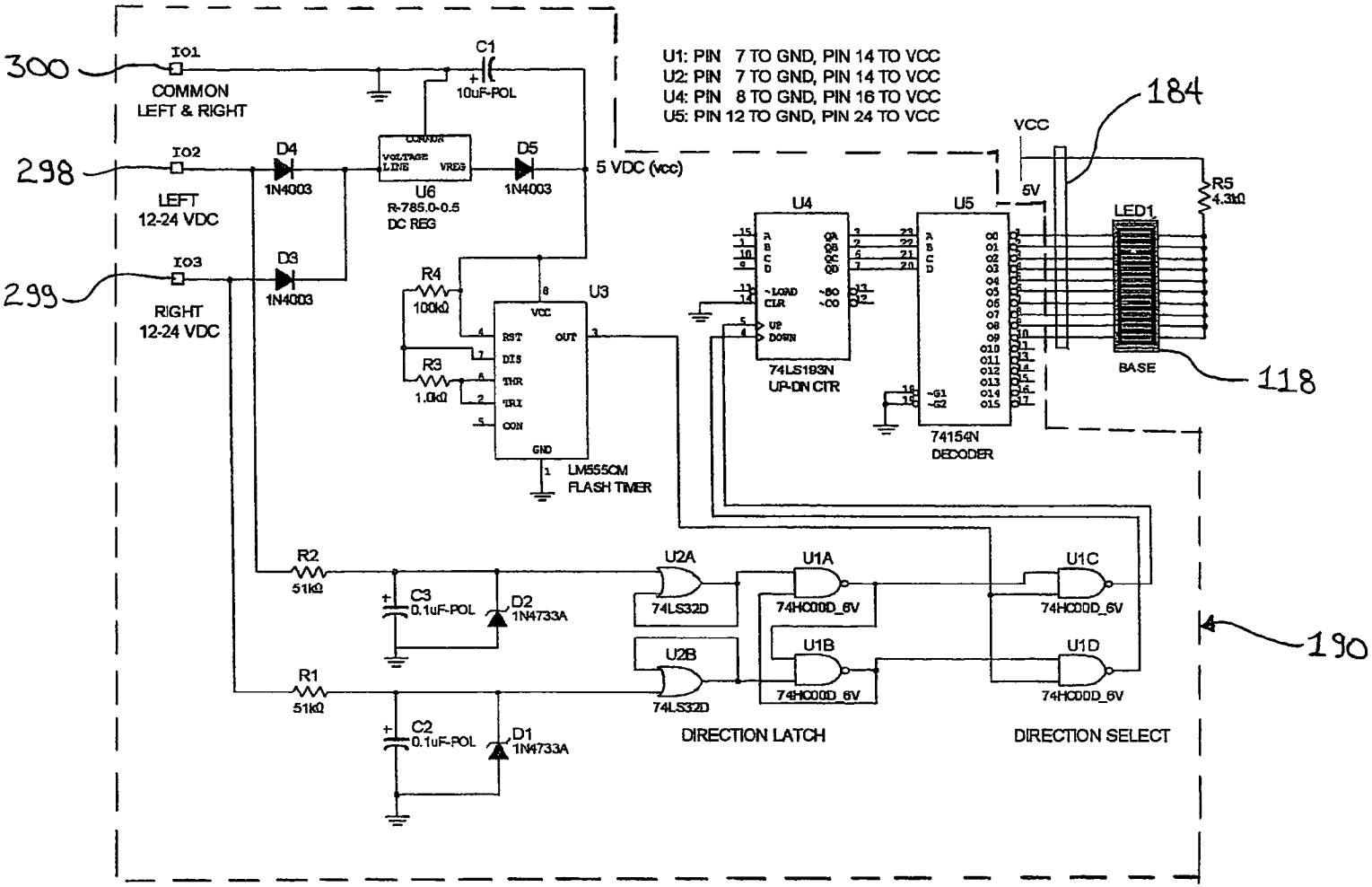
FIG. 12 is an electrical diagram of the circuit of the guide light controller of FIG. 11.

The construction and operation of guide light controller 170 and circuit 190 will now be described with reference to FIGS. 11 and 12, with FIG. 11 illustrating circuit 190 schematically as circuit 190'. Guide light controllers 170 are connected to smoke detectors 150 by cables or wires 181, with guide light controllers 170 receiving a voltage signal when either a smoke detector 150 detects smoke and/or when a signal is transmitted from control system 120 to a smoke detector 150 along a cable or wire 183. The voltage signal supplied to guide light controllers 170 will normally be either 12V or 24VDC, with the guide light devices 118 being able to receive either such voltage that may come from a generator or battery backup system used in emergency situations.

When a smoke detector 150 detects smoke, a signal is also sent to control system 120, which may be a standard fire panel or panel system located within a building that includes wiring, controls, and the like, for the various fire related equipment within the building, such as for smoke alarms, manual pull station boxes, and the like. Control system 120 upon receiving a signal from a specific smoke detector 150 may in turn transmit signals to other of the smoke detectors 150 within the building. Upon activation of the remaining smoke detectors 150, the associated guide light controllers 170 to those remaining smoke detectors may then also receive a signal and thereby cause the remaining associated guide light devices 118 to be activated. Although not shown, emergency lighting system 110 may also be activated by manual inputs, such as an occupant activated manual pull box input.

Figure 13:
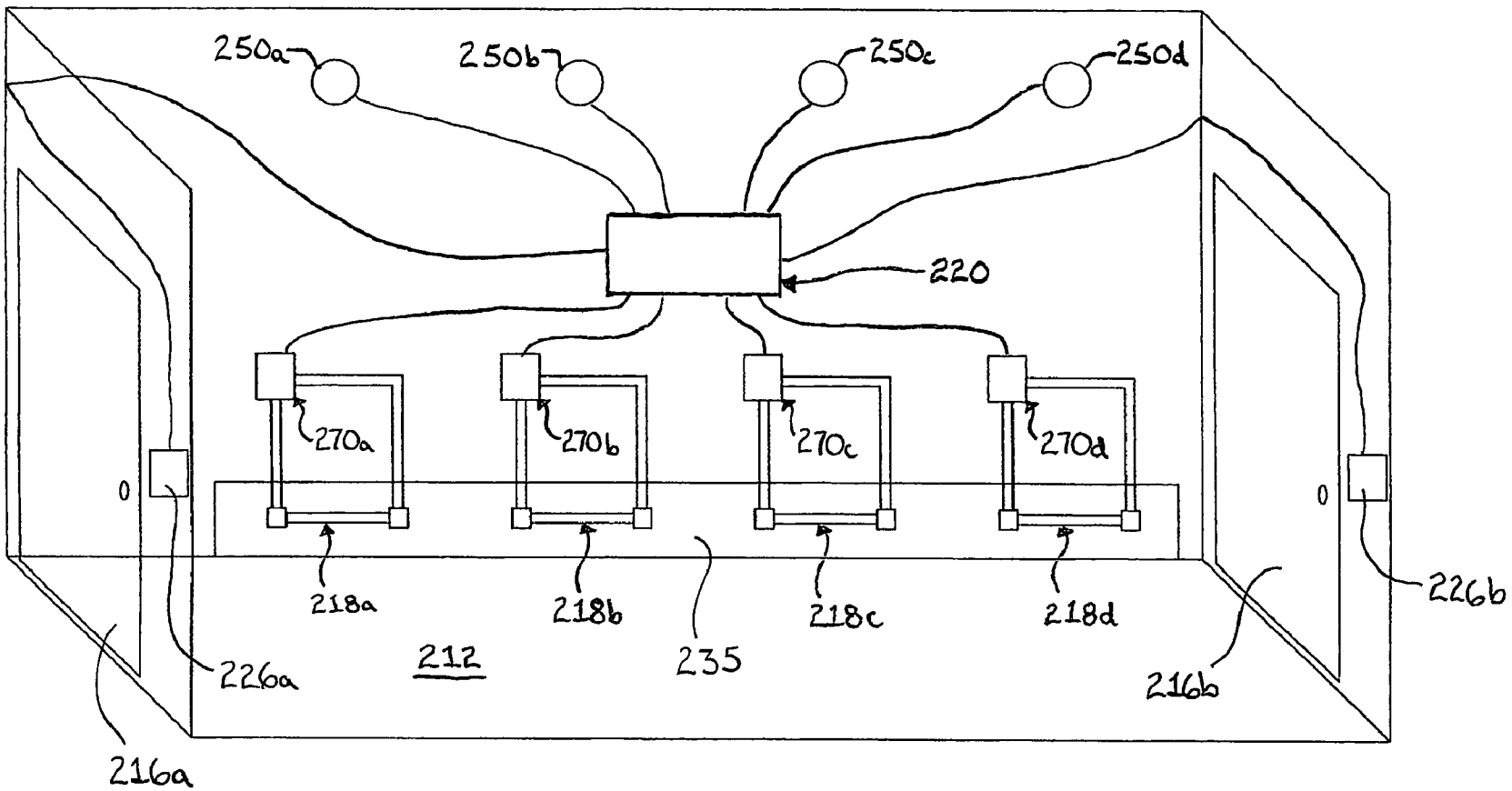
FIG. 13 is a schematic illustration of another emergency lighting system according to the present invention.

Referring now to FIG. 13, another alternative emergency lighting system 210 is shown that is of generally similar construction to the above discussed emergency lighting systems 10 and 110. The common or similar components or elements of emergency lighting system 210 are shown with similar reference numbers as used in FIGS. 1-7 with respect to emergency lighting system 10, but with 200 added to the reference numbers of FIG. 13, and with similar reference numbers as used in FIGS. 8-12, but with 100 added to the reference numbers of FIG. 13. It should be understood that, because of the similarity of emergency lighting system 110 to emergency lighting systems 10 and 110, not all of the specific construction and alternatives of like referenced parts will be discussed in the following discussion of emergency lighting system 110.

Emergency lighting system 210 is adapted for use in an interior location 212, such as within a building. For illustrative purposes, interior location 212 includes two exits 216*a*, 216*b*. Emergency lighting system 210 includes multiple signal devices, illustrated as smoke detectors 250 that are connected to a system control 220. System control 220 is mapped or programmed with the various locations and physical relations of smoke detectors 250 and exits 216, as well as manual signal devices and fire suppressant equipment, such as fire sprinklers (not shown) having electronic feedback to system control 220.

System control 220 may be a standard fire alarm panel or panel system located within the building that includes wiring, controls, and the like, for the various fire related equipment within the building, such as for smoke alarms, manual pull station boxes, and the like. Such standard fire alarm panel boxes may include a processor and system software that is capable of monitoring and controlling the various fire related equipment within the building, such as alarms, detectors, and the like. Examples of such fire alarm panels are the Quickstart, EST-2, and EST-3, fire alarm panels supplied by the Edwards System Technology ("EST") division of the General Electric Corporation utilizing the SDU software also supplied by EST.

Emergency lighting system also includes multiple guide light devices 218, each of which is connected to a guide light controller 270 that are each in turn connected to the system controller 220. In the illustrated embodiment, emergency lighting system 210 further includes manual signal devices, such as manual pull boxes 226*a*, 226*b* located adjacent exits 216*a*, 216*b*, respectively. Also in the embodiment shown, each guide light device 218 is associated with a smoke detector 250, as noted by the references a, b, c, and d, with the guide light device 218 being located or forming the floorboard 235 proximate the physical location of the associated smoke detector 250. That is, within system controller 220, each guide light device 218 and guide light controller 270 correspond or are associated with a particular signal device or smoke detector 250, either in the software of the system controller 220 or as a hardware association within system controller 220. It should be appreciated however, that more than one guide light device may be associated with a smoke detector and/or not all smoke detectors require an associated guide light device.

Although only four smoke detectors 250, four guide light devices 218, four guide light controllers 270, two manual signal devices 226, and two exits 216 are shown in the illustrated embodiment, it should be appreciated that an emergency lighting system 210 in accordance with the present invention may be adapted to be configured to numerous alternative building structures having various hallways, exits, floors, and stairwells.

The guide light devices 218 of emergency lighting system 210 may be of generally similar construction to guide light devices 118 described above in regard to emergency lighting system 110. In addition, in the illustrated embodiment, guide light controllers 270 may incorporate the circuit 190 described above in regard to guide light controllers 170 of emergency lighting system 110. Unlike guide light controllers 170, however, guide light controllers 270 do not incorporate a selective manual input switch for dictating the sequential flashing direction and pace of the light members (not shown) of guide light devices 218. Instead, as described in detail below, the sequential flashing direction is dictated by signals transmitted from system control 220 to the guide light controllers 170.

The operation of emergency lighting system 220 will now be described with reference to FIG. 13. If, for example, smoke detector 250*a* detects the presence of smoke or a fire, a signal will be transmitted to system control 220. In turn, system control 220 will transmit signals to guide light controllers 270*b*, 270*c*, 270*d*, but not to guide light controller 270*a*. The signal transmitted by system control 220 to guide light controllers 270*b*, 270*c*, 270*d* will activate guide light devices 218*b*, 218*c*, 218*d*. Furthermore, the signal transmitted by system control 220 will be coded such that guide light controllers 270*b*, 270*c*, 270*d* cause guide light devices 218*b*, 218*c*, 218*d* to create sequential flashing patterns directed toward exit 216*b*. System control may also cause smoke detectors 250*b*, 250*c*, 250*d* to emit an audible alarm. Alternatively, separate audible alarms (not shown) may be caused to sound.

Correspondingly, as a further example of the operation of emergency lighting system 220, if smoke detector 250*d* detects the presence of smoke or a fire, a signal will be transmitted to system control 220. In turn, system control 220 will transmit coded signals to guide light controllers 270*a*, 270*b*, 270*c*, but not to guide light controller 270*d*. The signal transmitted by system control 220 to guide light controllers 270*a*, 270*b*, 270*c* will cause guide light devices 218*a*, 218*b*, 218*c* to create sequential flashing patterns directed toward exit 216*a*.

As yet another example, if smoke detector 250*b* detects the presence of smoke or a fire, a signal will be transmitted to system control 220. In turn, system control 220 will transmit coded signals to guide light controllers 270*a*, 270*c*, 270*d*, but not to guide light controller 270*b*. The signal transmitted by system control 220 to guide light controller 270*a* will cause guide light device 218*a* to create a sequential flashing pattern directed toward exit 216*a*, and the signal transmitted by system control 220 to guide light controllers 270*c*, 270*d* will cause guide light devices 218*c*, 218*d* to create sequential flashing patterns directed toward exit 216*b*.

In like manner to the above, if manual pull box 226*a* is activated, a signal will be transmitted to control system 220. In turn, control system 220 will transmit coded signals to guide light controllers 270*a*, 270*b*, 270*c*, and 270*d*, which in turn will activate guide light devices 218*a*, 218*b*, 218*c*, and 218*d* to create sequential flashing patterns directed toward exit 216*b*.

As previously noted, guide light controllers 270 incorporate circuit 190 of guide light controllers 170. The operation of circuit 190 with guide light controllers 270 will now be described in more detail below with reference to FIGS. 11 and 12. As previously noted, control system 220 transmits a coded signal to circuit 190 of a guide light controller 270. In the illustrated embodiment, that code may consist of applying a voltage signal along a positive lead to either a left terminal 298 or a right terminal 299. The control system 220, upon receiving a signal from a smoke detector 250, thus determines which guide light controllers 270 to send signals to and in which direction the guide light devices 218 associated with those guide light controllers 270 should be activated to flash by transmitting the signal to the selected left or right terminal 298, 299.

As also previously noted, the voltage signal supplied to guide light controllers 270 will normally be either 12V or 24VDC, with the guide light controllers 270 being able to receive either such voltage that may come from a generator or battery backup system used in emergency situations. This voltage will then be regulated to a 5V DC output signal in the voltage regulator U6. Regulator U6 is a switching-type regulator that may accept inputs of 5.5-30 VCD and output 5 VCD, thus providing a wide range of compatibility with devices which operate at various voltage levels. As described below, the 5VCD output is utilized to both determine flash direction of the guide light members and as the positive voltage source to power the circuit 190 components.

As understood from FIG. 11, the signal conditions are connected to the same terminal 300 while the positive lead of one signal is connected to the left terminal 298 and the other positive to the right terminal 299. When a signal is applied to one of the terminals 298, 299, the light members, such as LED indicators, of the associated guide light device 218 will flash sequentially, one at a time, in the activated direction. The direction is determined by which left or right terminal input 298, 299 is energized first and a later signal to the other of the left or right terminal 298, 299 is ignored. Once the system of the guide light controller 270 and guide light device 218 is operating, the application of a second signal to the other of the left or right terminal input 298, 299 will not affect the direction in which the light members of the guide light device 218 are flashing. Nor will removal of the active input signal. The system is latched on until both signals are removed. Then the guide light controller 270 will reset waiting for an input signal from the control system 220. As previously described, the input 298, 299 which is first energized determines the direction the guide light device 218 will flash. Although not shown, AC input signals can be accommodated with the addition of a bridge rectifier/capacitor circuit to each left or right terminal input, ahead of the voltage regulators.

Regarding the direction select U1 of circuit, only gates A and B of direction select U1 are used in this circuit 190. Pin 1 of gate A is connected to the 5 VDC side of regulator U6 via D2 and pin 4 of gate B is connected to the 5 VDC side of U7 via D1. When a 5 volt signal is applied to either of these pins, pin 3 of gate A or pin 6 of gate B, respectively, will switch from a normal low state to a high state. Since pin 3 is connected to pin 2, pin 2 will be driven high, thus even if the signal is removed from pin 1, pin 3 will remain high. The same concept applies to gate B since pin 6 is connected to pin 5. This logic effectively latches on the output from either gate A or B until both input pins of a gate go low, that is when both inputs are removed from the guide light controller 270.

Regarding the direction latch U2, gates A and B of direction latch U2 are connected to the outputs of gates A and B of direction select U1 via pins 1 and 4, respectively. When a high state signal is applied to pin 1 of direction latch U2, pin 3 of gate A is driven high and applied to pin 4 of gate B. Likewise, a high signal supplied to pin 5 of gate B drives pin 6 high and it, being connected to pin 2 of gate A, drives pin A higher. If either input of these gates is low, the output (pin 3 or 6) will be high. If both inputs are high, the output will go low. Thus, gates A and B of direction latch U2 effectively work together to select the latch the first signal arriving from the output of voltage regulator U6.

Regarding the sequential flash timer U3, an approximate square wave timed pulse is generated by sequential flash timer U3 via the selection of appropriate resistor R1 and R2 and capacitor C2 values. This pulse is applied to either pin 4 or 5 of up-down counter U4 via direction latch U2. Counter U4 either adds to or subtracts from its current value depending upon whether a pulse is directed to the up or down input. The output of this counter consists of four discrete signal lines which express the current value in a binary coded decimal (BCD) format via pins 2, 3, 6 and 7. These outputs are applied to the input pins A, B, C and D on count output decoder U5.

Decoder U5 is a one of sixteen decoder device that accepts a BCD input and can drive output devices, such as the LED light members of guide light devices 218, for each count value received at the BCD input line. For example, the BCD value of "0" will activate output 00, a BCD input valve of "1" will activate output 01, and so forth, continuing though a BCD input value of "15", the maximum BCD value in the application. The outputs 00 through 15 are consecutively connected via a ribbon cable, such as ribbon cable 184 described above, to each of the sixteen LED light members of a guide light device 218 that are mounted on a section of vinyl baseboard for installation near the floor of the building. When counter U4 is counting up, the outputs will sequence from 00 to 15 as pulses are received from sequential flash timer U3. This provides a directional chasing pattern in one direction. When counting down, when the other of the left or right terminal input is energized, the outputs will turn on sequentially in the opposite direction from 15 to 00.

In the illustrated embodiment, the light members of guide light devices 218 are LED lights that emit a red light when approximately 2 VCD of the current polarity is applied. They are physically mounted through square holes spaced approximately 10 to 12 inches apart in the base material 235. Outputs from decoder U5, pins 00 through 15, are connected to the cathode of each LED by stripping the wire insulation and soldering to the individual construction, such as on a flat wire ribbon cable assembly. The anode of all the LED lights are connected to the positive conductor of the ribbon cable, with each LED anode leads attached to the same conductor. The positive conductor is connected to the 5 VCC (5 volt positive supply) via resistor R5, which is sized to limit the current applied to the LED light members. In the event of long ribbon cable runs it may be desirable to provide a current limiting resistor for each LED in order to reduce voltage drop and reduce electrical noise interference.

Diodes D1 and D2 are installed to prevent potential backfeed to the voltage regulator U6 and to prevent interference between direction signals. Similarly, diodes D3 and D4 are also installed to prevent potential backfeed to the voltage regulator. Polarized capacitors C1 and C2 are used to smooth the conditioned power supply signal.

It should be appreciated that emergency lighting systems 110 and 210 may be alternatively constructed and still function as intended within the scope of the present invention. For example, a guide light device may be constructed to include less than or more than sixteen LED light members. The circuit may also be alternatively constructed, for example a circuit may be constructed as an integrated circuit or chip, be formed from multiple electronic components, or any such hardware. Further, a guide light controller may be adapted to operate more than one guide light device and/or a signal device may be associated with more than one guide light controller.

The emergency lighting system of the present invention may be used in all manner of interior locations. For example, the emergency lighting system may be used in underground complexes, passageways, shopping malls, arenas, office buildings, residential complexes, department stores, hotels, and nightclubs. The emergency lighting system may also be used on ships, such as cruise ships, naval ships, cargo ships, and the like, to guide passengers or crew members from their cabins or other areas to the various locations on the deck to which they may disembark or board a lifeboat in an emergency.

The emergency lighting system of the present invention is readily installable within any interior location to selectively provide light signals that may guide occupants within the interior location both away from obstructed areas, based on the detected locations of emergency situations or hazardous areas, and out of the interior location. The guide light devices of the emergency lighting system are able to form a base molding, or portion of a base molding, such that they are readily installable to new or existing structures and do not detract from the aesthetic appearance of the structure. Alternatively, light members may be installed to a pre-existing or standard base board to form a guide light device. In addition, the guide light devices are able to provide light signals that are less likely to be blocked by smoke and which may selectively direct occupants in either one of at least two directions via arrows and/or sequentially flashing lights that form a "chasing" pattern.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which we claim an exclusive property or privilege is claimed are defined as follows:

1. An emergency lighting system adapted to guide occupants from an interior location of a structure, said emergency lighting system comprising:

at least one guide light device, said at least one guide light device adapted for installation within an interior location, said at least one guide light device including a plurality of illumination sources selectively activatable to emit light signals;

a selectively programmable guide light controller connected to said at least one guide light device, said programmable guide light controller including a manually selectable directional input switch and being selectively preset via said directional input switch to cause said illumination sources to provide a directional indication in a fixed one of two selectable directions based on the manually selected position of said directional input switch; and a signal device operatively connected to said programmable guide light controller, said signal device operable to generate an emergency input signal in response to an emergency situation with said programmable guide light controller activating said at least one guide light device in response to said emergency input signal to direct occupants from an interior location of a structure;

said at least one guide light device being mountable to a generally vertical surface within said interior location proximate a floor of said interior location.

2. The emergency lighting system of claim 1, wherein said light signals comprise a sequentially flashing signal, and wherein said programmable guide light controller includes a manually adjustable rate selector, said rate selector being manually adjustable to increase or decrease the rate at which said light signals sequentially flash.

3. The emergency lighting system of claim 2, further comprising a plurality of said guide light devices, a plurality of said programmable guide light controllers, and a plurality of said signal devices, wherein each said guide light controller is connected to a separate said guide light device and each said signal device is operatively connected to a said programmable guide light controller.

4. The emergency lighting system of claim 1, further including a control system with said signal device and said programmable guide light controller being connected to said control system, said signal device being adapted to generate said emergency input signal in response to an emergency situation, and wherein said control system selectively activates said programmable guide light controller in response to said emergency input signal to activate said guide light controller to emit said light signals in the preprogrammed direction to guide occupants generally away from the emergency situation.

5. The emergency lighting system of claim 4, further including a plurality of said guide light devices, a plurality of said programmable guide light controllers, and a plurality of said signal devices located within said interior location, and wherein each said signal device is adapted to selectively generate an emergency input signal in response to an emergency situation proximate said signal device, and wherein said control system is adapted to selectively activate at least one said guide light device to emit said light signals to guide occupants away from said signal devices generating said emergency input signals.

6. The emergency lighting system of claim 1, wherein said emergency input signal is generated by at least one selected from the group consisting of a manual signal device and an automated signal device.

7. The emergency lighting system of claim 6, wherein said automated signal device is at least one selected from the group consisting of a smoke detector, a heat sensor, a water flow sensor, and a gas sensor.

8. The emergency lighting system of claim 1, wherein said at least one guide light device is adapted to form at least a portion of a base molding adjacent a floor surface.

9. The emergency lighting system of claim 2, wherein said programmable guide light controller is further programmable to control the rate at which said light signals sequentially flash.

10. The emergency lighting system of claim 4, further including a warning detection device, said warning detection device being adapted to transmit an alert signal to an emergency response service in response to said at least one emergency input signal.

11. A method of guiding occupants from an interior location of a structure in which an emergency situation has arisen, said at least one method comprising:

providing at least one guide light device having a plurality of light members there along;

providing a programmable guide light controller, said programmable guide light controller being connected to said guide light device and including a manually selectable directional input switch for selectively presetting the light members to provide a directional indication in a fixed one of two selectable directions based on the manually selected position of said directional input switch;

attaching said at least one guide light device to a generally vertical surface within the interior location proximate a floor of the interior location;

presetting said programmable guide light controller to activate the light members to provide a directional indication toward an exit;

detecting the existence of an emergency situation within an interior location;

generating at least one emergency signal in response to said detecting;

selectively activating said at least one guide light device to emit light signals in response to the at least one emergency signal; and guiding occupants toward an exit with the light signals.

12. The method of claim 11, wherein the guide light device is adapted to form at least a portion of a base molding adjacent a floor surface.

13. The method of claim 11, further including a signal device, and wherein said generating at least one emergency signal in response to said detecting comprises generating said emergency signal by said signal device.

14. The method of claim 11, wherein emitting light signals comprises emitting sequentially flashing light signals.

15. An emergency lighting system adapted to guide occupants from an interior location of a structure, said emergency lighting system comprising:

a control system;

a plurality of guide light devices, each said guide light device including a plurality of light members selectively activatable to emit light signals;

a plurality of selectively programmable guide light controllers, each said programmable guide light controller being connected to separate said guide light devices and adapted to activate at least one said guide light device, each said programmable guide light controller including a manually selectable directional input switch and being preset via said directional input switch to cause said at least one guide light device to emit sequentially flashing light signals in a fixed one of two selectable directions based on the manually selected position of said directional input switch;

a plurality of signal devices, each said signal device being operatively connected to at least one said programmable guide light controller and adapted to selectively detect an emergency situation within an interior location and transmit an emergency signal;

said control system being adapted to transmit control signals in response to the detection of an emergency situation to selected ones of said guide light controllers, whereby said guide light controllers receiving said control signals activate said guide light devices to emit sequentially flashing light signals in the preselected direction of said directional input switches of the selected said guide light controllers.

16. The emergency lighting system of claim 15, wherein said signal devices and said programmable guide light controllers are connected to said control system, and wherein said control system activates said programmable guide light controllers in response to the detection of an emergency situation.

17. The emergency lighting system of claim 15, wherein said signal devices are connected to said control system and wherein each said signal device is connected to at least one said programmable guide light controller, and wherein said guide light devices are activated by said signal devices.

18. The emergency lighting system of claim 15, wherein said control system comprises a fire alarm panel.

19. The method of claim 14, wherein said programmable guide light controller includes a manually adjustable rate selector to control the rate at which said light signals sequentially flash, and wherein said presetting said programmable guide light controller to activate the light members includes adjusting said manually adjustable rate selector to set the rate at which said light signals sequentially flash.

* * * * *